US011225103B1

(12) United States Patent
Bowie

(10) Patent No.: US 11,225,103 B1
(45) Date of Patent: Jan. 18, 2022

(54) PORTABLE DRY ERASE BOARD

(71) Applicant: Ronald Anthony Bowie, Fort Worth, TX (US)

(72) Inventor: Ronald Anthony Bowie, Fort Worth, TX (US)

( * ) Notice: Subject to any disclaimer, the term of this patent is extended or adjusted under 35 U.S.C. 154(b) by 0 days.

(21) Appl. No.: 14/079,257

(22) Filed: Nov. 13, 2013

(51) Int. Cl.
*B43L 1/00* (2006.01)

(52) U.S. Cl.
CPC ..... *B43L 1/00* (2013.01)

(58) Field of Classification Search
CPC ..... B43L 1/00; B43L 1/06; B43L 1/08
USPC ..... 434/410, 413, 414, 415–425
See application file for complete search history.

(56) References Cited

U.S. PATENT DOCUMENTS 553,938 A * 2/1896 Reichelt ..... A44B 1/34 24/114.4
748,411 A * 12/1903 Neuberth ..... A44B 3/02 24/101 R
4,130,369 A * 12/1978 Wojcik ..... F16B 19/02 29/526.2
4,784,550 A * 11/1988 Wollar ..... F16B 19/1081 411/32
4,828,502 A * 5/1989 Leahy ..... B43L 1/06 434/416
5,305,114 A * 4/1994 Egashira ..... B43L 1/04 248/166
5,492,476 A * 2/1996 Ball ..... B43L 1/06 40/605
5,752,837 A * 5/1998 Palmer ..... B43L 1/08 434/408
5,775,919 A * 7/1998 Gardner ..... B43L 1/04 40/594
5,839,991 A * 11/1998 Hall ..... A63B 23/00 482/23
6,263,602 B1 * 7/2001 Seiber ..... G09F 15/00 40/594
6,582,236 B1 * 6/2003 Dian ..... B43L 1/00 434/408
6,648,051 B1 * 11/2003 Young ..... B43L 1/08 160/135
6,663,073 B1 * 12/2003 Church ..... A47B 97/08 248/458
8,047,851 B1 * 11/2011 Baxter ..... B43K 23/001 434/408
8,281,943 B2 * 10/2012 Suman ..... A47F 5/0087 211/150
8,403,021 B1 * 3/2013 Peterson ..... A47G 5/00 160/135
9,217,452 B1 * 12/2015 Woodall, Jr ..... F16B 13/0833
2001/0040207 A1 * 11/2001 Richardson ..... A47B 97/08 248/460
2002/0009703 A1 * 1/2002 Owen ..... B43L 1/00 434/408

(Continued)

*Primary Examiner* — Paul A D'Agostino
(74) *Attorney, Agent, or Firm* — Leavitt Eldredge Law Firm

(57) ABSTRACT

A system includes a foldable dry erase board forming a continuous surface area for writing thereon. The dry erase board includes a first panel foldably attached to a second panel about a pivot joint. The method includes creating the continuous dry erase marker board surface with the first panel and the second panel and folding the first panel onto the second panel about the pivot joint extending partially through a thickness of the board.

7 Claims, 4 Drawing Sheets

(56) References Cited

U.S. PATENT DOCUMENTS

2003/0049587 A1* 3/2003 Polick ..... B42D 1/00 434/156
2003/0077562 A1* 4/2003 Donelan ..... B43L 1/00 434/408
2003/0106979 A1* 6/2003 Richardson ..... A47B 97/08 248/460
2003/0152908 A1* 8/2003 Lopez ..... B43L 1/00 434/408
2004/0071495 A1* 4/2004 Legrand ..... B42D 3/10 402/8
2004/0121296 A1* 6/2004 Baker ..... G09B 1/00 434/262
2004/0175250 A1* 9/2004 Yoneoka ..... F16B 19/1081 411/45
2005/0152765 A1* 7/2005 Kato ..... F16B 19/1081 411/45
2006/0016951 A1* 1/2006 Nash ..... A47B 97/04 248/441.1
2006/0081758 A1* 4/2006 Lee ..... A47B 97/08 248/459
2006/0183101 A1* 8/2006 Williams ..... B43L 1/06 434/408
2006/0214922 A1* 9/2006 Moore ..... B43L 1/00 345/173
2006/0219708 A1* 10/2006 Haglund ..... B43L 1/00 219/633
2007/0077815 A1* 4/2007 White ..... B43K 23/001 439/607.01
2007/0085269 A1* 4/2007 Martin ..... A63F 9/10 273/157 R
2007/0102384 A1* 5/2007 Albenda ..... A47B 96/202 211/85.26
2007/0215011 A1* 9/2007 Khan ..... A47B 85/06 108/11
2008/0286744 A1* 11/2008 Cheris ..... B43K 23/002 434/408
2009/0160172 A1* 6/2009 Dudley ..... B42D 1/001 281/21.1
2010/0267001 A1* 10/2010 Sugai ..... B43L 1/00 434/408
2010/0279580 A1* 11/2010 Sanford ..... A63H 33/38 446/147
2011/0042541 A1* 2/2011 Spencer ..... A47B 97/001 248/447.1
2011/0045454 A1* 2/2011 McManus ..... A47B 97/04 434/408
2012/0171926 A1* 7/2012 Crnecki ..... A63H 33/008 446/478
2013/0145585 A1* 6/2013 Watanabe ..... F16B 19/1081 24/595.1
2013/0280691 A1* 10/2013 O'Connor ..... B43L 1/00 434/408
2014/0259818 A1* 9/2014 Cushing ..... G09F 1/06 40/124.14
2014/0272918 A1* 9/2014 Marshall ..... A47B 97/001 434/421
2015/0056599 A1* 2/2015 O'Connor ..... B42F 13/16 434/407
2015/0125846 A1* 5/2015 Langford ..... G09F 21/02 434/408
2016/0355049 A1* 12/2016 Thomas ..... B43L 1/00

* cited by examiner

PORTABLE DRY ERASE BOARD

BACKGROUND

1. Field of the Invention

The present invention relates generally to dry erase boards, and more specifically, to a portable, foldable dry erase board.

2. Description of Related Art

Dry erase boards are well known in the art and are effective means for displaying. In one exemplary use, the dry erase board is rigidly attached to a wall of a classroom and written upon by the instructor during lecture. It is known that various uses of the dry erase board are found, resulting in the dry erase board being manufactured in various shapes and sizes; however, it should be understood that dry erase boards are not easily portable, thereby limiting displaying use.

Although the foregoing developments in the above-described dry erase boards represent great strides, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
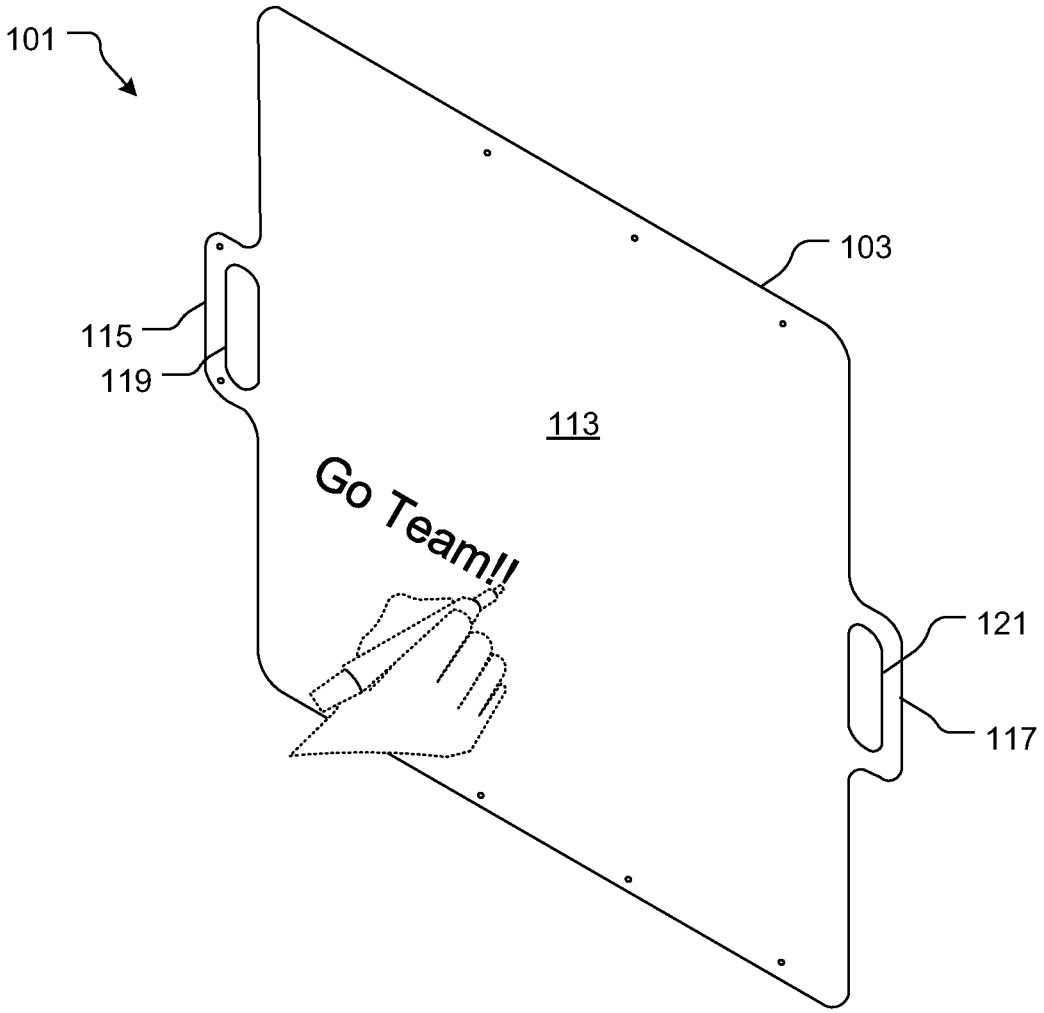
FIG. 1 is an oblique front view of a dry erase board system in accordance with a preferred embodiment of the present application.

While the dry erase board system and method of use pursuant to the disclose of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the system and method of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes the above-discussed problems commonly associated with conventional dry erase boards. Specifically, the system of the present application includes a board that is foldable and portable, thereby significantly increasing the displaying use in various locations. These and other unique features of the system and method are discussed below and illustrated in the accompanying drawings.

The system and method of use will be understood, both as to its structure and operation, from the accompanying drawings, taken in conjunction with the accompanying description. Several embodiments of the safe room are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
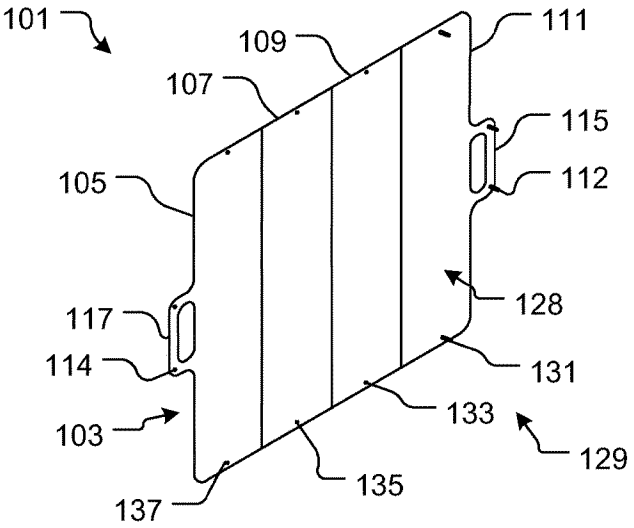
FIG. 2 is an oblique back view of the dry erase board system of FIG. 1.
Figure 3:
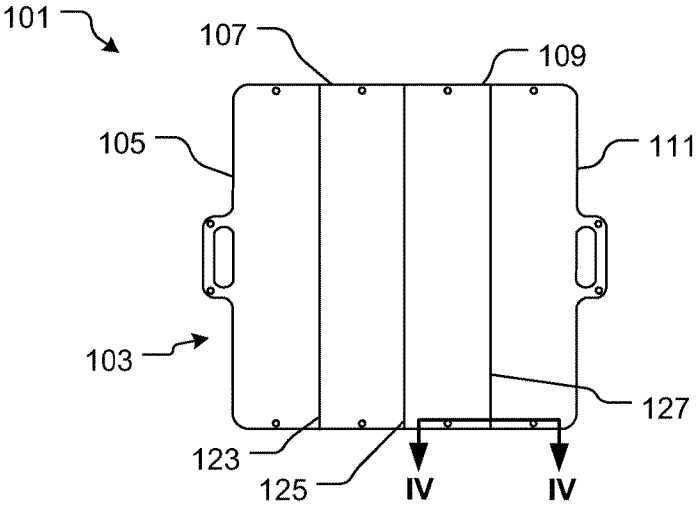
FIG. 3 is a frontal view of the dry erase board system of FIG. 2.

Referring now to the drawings wherein like reference characters identify corresponding or similar elements throughout the several views, FIGS. 1-3 illustrate various views of a dry erase board system 101 in accordance with a preferred embodiment of the present application.

In the contemplated embodiment, system 301 includes one or more of a dry erase board 103 having four panels: a first panel 105, a second panel 107, a third panel 109, and a fourth panel 111, all being joined about pivot joints. The panels form a continuous surface 113 for writing thereupon with, for example, a dry erase marker (shown in phantom). Although shown having four panels, it will be appreciated that alternative embodiments could include more or less panels depending on the design choice and preferred use. Further, although shown in rectangular shapes, it will be appreciated that the panels can also be manufactured having different shapes and sizes in alternative embodiments.

In the preferred embodiment, board 103 is manufactured with a plastic material that creates a continuous surface for writing thereon with a dry erase marker. The plastic material also allows easy removal of the ink markings with an eraser. However, it is also contemplated manufacturing board 103 with other materials that also share the same features discussed herein.

Board 103 is preferably provided with one or more handles 115, 117 that are integral with respective panels 105, 111 and configured to allowing gripping and carrying access of board 103 during transit and display. The handles 115, 117 are manufactured with two respective holes 119, 121 passing through a thickness of board 103 for allowing a hand of the user to pass therethrough.

Handles 115, 117 are further optionally provided with a fastener 112 configured to secure to a hole 114 for interlocking thereto while the panels are folded. This feature allows the board to be securely retained in the folded position during transit. It will be appreciated that other fastening device, e.g., hook-loop, snap, and the like, are also contemplated in lieu of a fastener configured to pass through and secure to a hole.

Figure 6C:
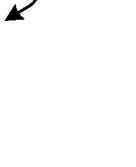
FIGS. 6A-6C are top views of the dry erase board system of FIG. 1.
Figure 6B:
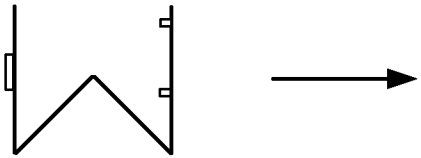
Figure 6A:
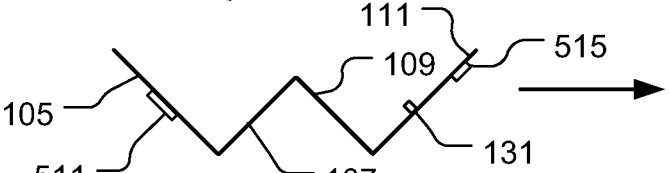

One of the unique features believed characteristic of system 101 is the ability to fold board 103 into a manageable size for transport (see FIGS. 6A-6B). To achieve this feature, system 101 includes a plurality of pivot joints, for example, grooves 123, 125, 127 between and joining each panel. The pivot joints are configured to extend the entire length of the panels, as shown, thereby allowing folding between the panels.

Figure 4:
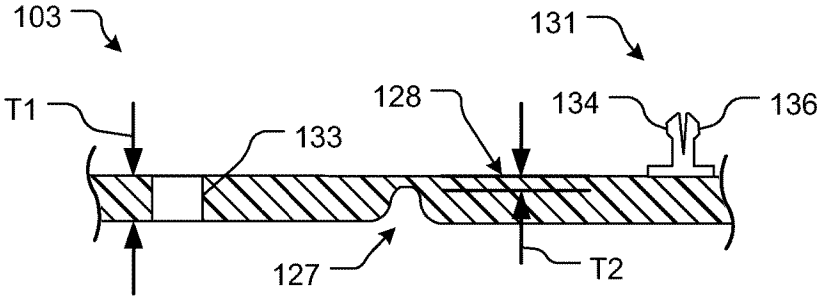
FIG. 4 is an enlarged cross-sectional view of a portion of the dry erase board system taken at IV-IV of FIG. 3.

In the contemplated embodiment, the pivot joints extend within at least partially through the thickness T1 of the board, thereby leaving a thickness T2 between the groove and the surface 113 (see FIG. 4). It should be noted that in the contemplated embodiment, the grooves do not extend through the entire thickness. This feature allows a continuous surface 113 substantially devoid of cracks, creases, or the like to be formed. However, it will be appreciated that it is also contemplated having alternative embodiments wherein the panels are separated from each other and wherein hinges, tape, and other suitable pivot joints are utilized to secure the panels to each other.

Another unique feature believed characteristic of system 101 is the ability to fasten the panels together while in the folded position. To achieve this feature, it is contemplated utilizing a fastener system 129 configured to secure the panels to each other while in the folded position (see, e.g., FIG. 6C). Fastener system 129 preferably includes a fastener 131 protruding from a surface 128 of panel 111 and operably associated with three holes 133, 135, and 137 passing through respective panels 109, 107, and 105. Thus, in the contemplated embodiment, fastener 131 is configured to extend through holes 133, 135, and 137 and securely attach to panel 105 (see, e.g., FIG. 6C). For ease of description, only one of the two fastener systems is discussed in detail; however, it is also contemplated having at least two fastener systems 129 in the preferred embodiment at opposing ends of the panels, as depicted.

It will be appreciated that it is also contemplated utilizing different fastener systems in alternative embodiments. For example, an alternative embodiment could utilize a strap configured to wrap at least partially around the folded panels and to be secured in fixed position via one or more fasteners, e.g., snaps, clips, loop-hook, and so forth.

One unique feature believed characteristic of system 101 is the ease of manufacturing. As discussed, the preferred embodiment includes a plurality of panels integrally joined via pivot joints along with handles and fastener that are also integrally attached to the panels. As such, it is contemplated utilizing an injection molding process to manufacture system 101, which greatly reduces costs.

Referring specifically to FIG. 4 in the drawings, an enlarged cross-sectional view of board 103 is shown taken at IV-IV of FIG. 3. In the contemplated embodiment, groove 127 is manufactured in a bell-shaped configuration, which provides ideal bending movement between the two adjacent panels. As depicted, groove 127 is configured to extend partially through the thickness "T1" of the board 103, thereby allowing a continuous surface 113 on the opposing end of the board.

FIG. 4 also depicts a fastener 131 rigidly attached to and protruding from a surface 128 of panel 111. In the contemplated embodiment, fastener 131 is integral with board 103; a feature that greatly reduces the overall cost of manufacturing. In the exemplary embodiment, fastener 131 is manufactured with two elongated members 134, 136 that extend apart from each other and are configured to pass through holes 133, 135, and 137.

Figure 5B:
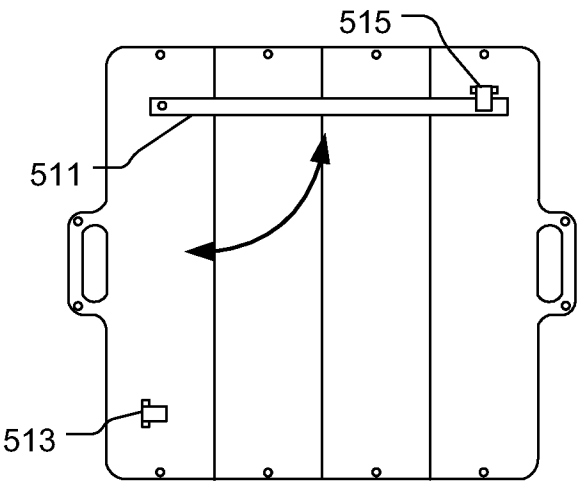
FIGS. 5A and 5B are back views of a dry erase board system according to an alternative embodiment of the present application.
Figure 5A:
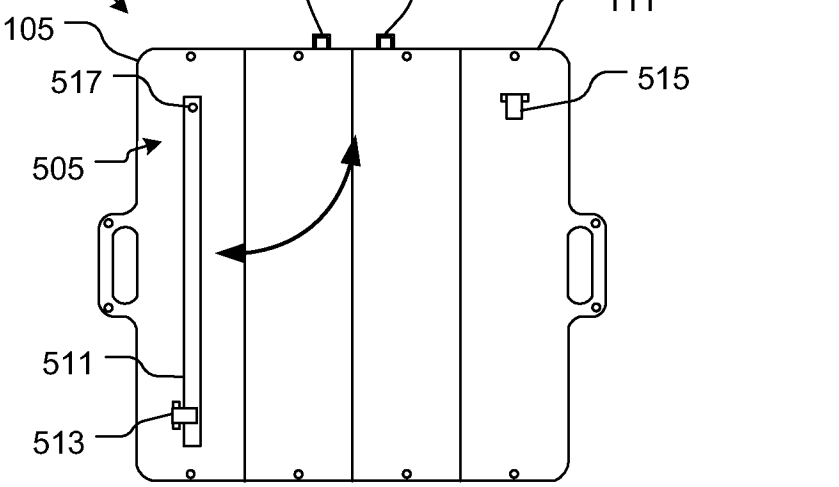

FIGS. 5A-5B illustrates an alternative embodiment of system 101. As depicted, system 501 is substantially similar in form and function to system 101 and includes the additional features of a hanger system 503 and a locking mechanism 505. It will be appreciated that the features discussed herein with respect to system 101 are hereby incorporated in system 501 although not reiterated, but shown and referenced in the drawings.

Hanger system 503 preferably includes one or more hanger members 507, 509 integrally secured to one or more panels and configured to secure to a fastener (not shown) associated with an easel, wall, and/or other similarly suitable support structures.

Locking mechanism 505 is configured to secure the panels relatively parallel to each other, thereby creating a relatively flat, continuous surface 113. In the contemplated embodiment, locking mechanism 505 includes an elongated member 511 operably associated with locks 513, 515 on respective panels 105, 111. During use, elongated member 511 pivots about a pivot point 517 from lock 513 to lock 515, as depicted with an arrow. Lock 513 is configured to secure member 511 during transit, while lock 515 is configured to secure member 511 during use. Thus, locking mechanism 505 effectively holds the panels in a secured position relatively parallel to each other. It will be appreciated that system 501 could include additional locking mechanism than illustrated in the depicted embodiment. For example, two locking mechanisms could be utilized to add additional rigidity.

In the exemplary embodiment, locks 513, 515 are manufactured having a L-shaped configuration to received the rectangular elongated member 511. The locks are configured to receive and friction lock with the elongated member; however, it is also contemplated utilizing other locking means, including, but not limited to adhesive, hook-loops, clips, snaps, fasteners, and the like in lieu of the preferred embodiment.

Referring now to FIGS. 6A-6C in the drawings, top views of system 501 are shown during the folding process. FIG. 6A shows the initial process of folding board 103, FIG. 6B shows the transitory stage, while FIG. 6C shows the folded position with the locking mechanism securing the panels in a relatively fixed position, ready for transit.

Figure 7:
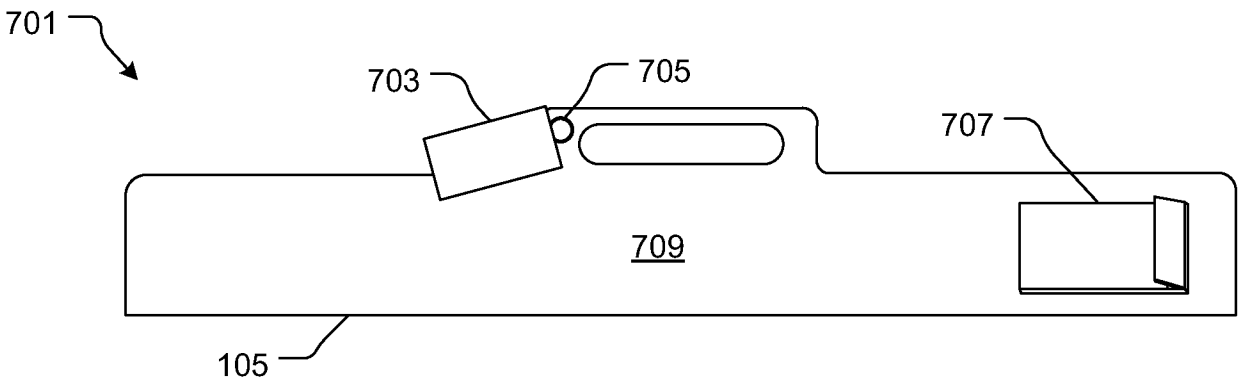
FIG. 7 is a folded side view of the dry erase board system in accordance with an alternative embodiment.

FIG. 7 illustrates an alternative embodiment of systems 101 and 501. As depicted, system 701 is substantially similar in form and function to systems 101 and 501 and includes the additional feature of adding a pocket 703 to panel 105 via a fastener 705 and/or a pocket 707 secured to a surface 709 of panel 105. It will be appreciated that the features discussed herein with respect to systems 101 and 501 are hereby incorporated in system 701 although not reiterated, but shown and referenced in the drawing.

In the contemplated embodiment, pocket 703 is configured to hold dry erase markers, erasers, and the like. The pocket 703 is removably attached to system 701 via a fastener 705, which could include a quick-release device, hook-loop device, snap, clip, and the like. This feature allows easy removal of pocket 703 during non-use.

Whereas, pocket 707 remains secured to panel 105 and is configured to store markers, erasers, and the like.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system, comprising:

a foldable dry erase board forming a continuous writing surface area, the dry erase board, having:

a first panel foldably and integrally attached to a second panel about a pivot joint, the pivot joint being a groove extending inwardly on an opposing surface to the continuous surface area, the groove being configured to extend an entire width of the first panel and configured to extend partially within a depth of the first panel such that a thickness remains between the continuous writing surface and the opposing surface;

a fastener system, having:

a protrusion extending from the continuous writing surface on the first panel; and a hole extending through a thickness of the second panel;

wherein the protrusion extends through the hole when the first panel and second panel are folded together, thereby securing the first panel and second panel together; and a locking mechanism, having:

an elongated member rotatably attached to opposing surface of the first panel; and a lock secured to the second panel;

wherein the elongated member pivots and engages with the lock;

wherein the first panel is configured to fold onto the second panel forming a flat writing when in an unfolded position.

2. The system of claim 1, further comprising:

a first handle extending from the first panel; and a second handle extending from the second panel;

wherein the first handle and the second handle provide gripping access of the dry erase board.

3. The system of claim 2, further comprising:

a first hole that extend through a thickness of the first handle; and a second hole that extend through a thickness of the second handle;

wherein the first hole aligns with the second hole while the first panel is folded onto the second panel.

4. The system of claim 1, further comprising:

a hanger assembly configured to secure the dry erase board to a support structure.

5. The system of claim 1, further comprising:

a pocket secured to the first panel.

6. The system of claim 5, wherein the pocket is releasably attached to the first panel.

7. A system, comprising:

a foldable dry erase board forming a continuous surface area for writing thereon, the dry erase board, having:

a first panel foldably and integrally attached to a second panel about a first pivot joint the first pivot joint being a first groove extending inwardly on an opposing surface to the continuous surface area, the first groove being configured to extend an entire width of the first panel and configured to extend partially within a depth of the first panel such that a thickness remains between the continuous writing surface and the opposing surface;

a third panel foldably and integrally attached to a fourth panel about a second pivot joint and foldable attached to the second panel about a third pivot joint the second pivot joint being a second groove extending inwardly on an opposing surface to the continuous surface area, the second groove being configured to extend an entire width of the third panel and configured to extend partially within a depth of the third panel such that a thickness remains between the continuous writing surface and the opposing surface;

wherein the first panel is configured to fold onto the second panel, the second panel configured to fold onto the third panel, and the third panel configured to fold onto the fourth panel;

a fastener system, having:

a protrusion extending from the continuous writing surface on the first panel;

a first hole extending through a thickness of the second panel;

a second hole extending through a thickness of the third panel; and a third hole extending through a thickness of the fourth panel; and a locking mechanism, having:

an elongated member rotatably attached to opposing surface of the first panel; and a lock secured to the second panel;

wherein the elongated member pivots and engages with the lock;

wherein the protrusion aligns with and extends through the first, second, and third holes when the first panel, second panel, third panel, and fourth panel are folded together, thereby securing the first panel, second panel, third panel, and fourth panel together when in a folded configuration.

* * * * *